US006928745B2

(12) United States Patent
Lickiss et al.

(10) Patent No.: US 6,928,745 B2
(45) Date of Patent: Aug. 16, 2005

(54) CLOTHES DRYER WITH CONTROL PANEL SEAL

(75) Inventors: Chris P. Lickiss, Newton, IA (US); Curtis J. Tremel, Newton, IA (US); Joseph M. Keeler, Colfax, IA (US); Troy A. Johnson, Newton, IA (US); Michael C. Roberts, Bastrop, TX (US); Burton R. Vander Schel, Newton, IA (US); Dale D. Vander Heiden, Newton, IA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/627,276

(22) Filed: Jul. 25, 2003

(65) Prior Publication Data

US 2005/0016016 A1 Jan. 27, 2005

(51) Int. Cl.[7] ..... F26B 25/00
(52) U.S. Cl. ..... 34/104; 34/606
(58) Field of Search ..... 34/104, 106, 202, 34/219, 596, 600, 604, 606; 68/20, 142

(56) References Cited

U.S. PATENT DOCUMENTS

| | | | |
|---|---|---|---|
| 2,443,069 | A | 6/1948 | Gayring |
| 3,197,886 | A | 8/1965 | Brame et al. |
| 3,256,616 | A | 6/1966 | McGoldrick |

(Continued)

FOREIGN PATENT DOCUMENTS

| | | | |
|---|---|---|---|
| EP | 0 758 694 | A1 | 2/1997 |
| EP | 0816552 | A3 | 1/1998 |
| EP | 0816552 | B1 | 1/1998 |
| GB | 2 238 322 | A | 5/1991 |
| GB | 2 289 752 | A | 11/1995 |
| GB | 2 321 954 | A | 12/1998 |
| GB | 2 345 493 | A | 12/2000 |
| JP | 01-303199 | | 7/1989 |
| JP | 63-135332 | | 7/1989 |
| JP | 3207399 | | 9/1991 |
| JP | 3289999 | | 12/1991 |
| JP | 404084998 | A | 3/1992 |
| JP | 4126198 | | 4/1992 |
| JP | 404156896 | A | 5/1992 |
| JP | 19900269123 | | 5/1992 |
| JP | 404187194 | A | 7/1992 |
| JP | 5208096 | | 8/1993 |
| JP | 405208096 | A | 8/1993 |
| JP | 406339598 | A | 12/1994 |
| JP | 4089099 | | 3/1999 |
| WO | WO 95/32330 | | 11/1995 |
| WO | WO 00/75413 | A1 | 12/2000 |

OTHER PUBLICATIONS

Sharp Press Release Feb. 19, 2001 Sharp Introduces Two new Dehumidifiers for Fiscal 2001 DW–M16 is Industry's First "Plasma Cluster" Laundry drying dehumidifier, DW–M16G is New Fast–Drying Laundry Dehumidifier; Cluster Ions Catch Bacteria and Odor 16–Liter/Day Moisture Removal Capacity means Fast Drying.

The Laundry Alternative, Inc. web site, Oct. 2002.

Wet Cleaning Equipment Report by Anthony Star and Cindy Vasquez, May 1997.

628–01–02: Total Laundry Solution (TLS) Australian Design Awards web page, Oct. 2002.

*Primary Examiner*—Stephen Gravini
(74) *Attorney, Agent, or Firm*—McKee, Voorhees & Sease; Allan P. Orsund

(57) ABSTRACT

An appliance with an internal working space has a door to provide access to the working space. A control panel is operatively mounted on the appliance. A seal mounted on the door sealingly engages with an upright wall on the control panel when the door is closed to prevent migration of moisture toward the components of the control panel. The door also includes a sloped inner wall terminating in a lip, which directs moisture away from the seal and control panel components

13 Claims, 3 Drawing Sheets

U.S. PATENT DOCUMENTS 3,292,645 A * 12/1966 Braden et al. ..... 134/57 D
3,417,481 A 12/1968 Rumsey, Jr.
3,584,393 A * 6/1971 Mentor ..... 34/562
3,594,917 A 7/1971 Montgomery
3,601,292 A 8/1971 Bliss
3,619,592 A * 11/1971 Lamb, Jr. ..... 362/91
3,670,425 A 6/1972 Benjamin et al.
3,712,086 A 1/1973 Payet et al.
3,739,496 A 6/1973 Buckley et al.
3,805,404 A * 4/1974 Gould ..... 34/75
3,805,561 A 4/1974 Bullock
3,849,815 A 11/1974 Frauendorf
4,304,053 A 12/1981 Kellerhals et al.
4,531,387 A * 7/1985 Cotton et al. ..... 68/3 R
4,625,432 A 12/1986 Baltes
4,819,341 A 4/1989 Gayso
4,972,687 A * 11/1990 Czech et al. ..... 68/3 R
4,998,587 A * 3/1991 Thomas ..... 169/51
5,094,020 A 3/1992 Wingfield et al.
5,107,603 A 4/1992 Durazzani
5,142,077 A 8/1992 Martin et al.
5,174,618 A * 12/1992 Kropf ..... 292/254
5,305,484 A 4/1994 Fitzpatrick et al.
5,369,892 A 12/1994 Dhaemers
5,516,012 A 5/1996 Weigel
5,546,678 A * 8/1996 Dhaemers ..... 34/275
5,672,187 A * 9/1997 Rock et al. ..... 95/219
5,730,006 A 3/1998 Conley
5,799,594 A * 9/1998 Dernjatin et al. ..... 110/265
5,815,961 A 10/1998 Estes et al.
5,836,324 A * 11/1998 Johnson et al. ..... 134/58 D
5,996,249 A 12/1999 Manning
6,189,346 B1 2/2001 Chen et al.
6,263,591 B1 7/2001 La Porte
6,279,357 B1 * 8/2001 Didlick et al. ..... 68/20
6,363,627 B1 4/2002 Lai
6,425,192 B2 7/2002 Arrieta et al.

* cited by examiner

CLOTHES DRYER WITH CONTROL PANEL SEAL

BACKGROUND OF THE INVENTION

Clothes dryers, and other household appliances include a drying space or internal working space inside a cabinet, with a door to provide access to the internal area. The appliance typically includes a control panel with exterior buttons for controlling operation of the appliance after the door is closed. The door typically includes a seal for sealingly engaging a portion of the housing around the access opening so as to preclude leakage of moisture and/or hot air during operation of the appliance. The control panel typically is spaced apart from the door to preclude exposure to moisture. More particularly, clothes dryers have sealing doors which preclude escape of both hot air and moisture driven from the wet clothes being dried. The seal typically is mounted on the interior of the dryer door and engages a flange or other surface surrounding the access opening. Such door seals are conventionally found on both tumble dryers and cabinet dryers. In the design of such dryers, and other appliances, the location of the control panel is important so as to preclude any detrimental effects from moisture or air temperatures.

Accordingly, a primary objective of the present invention is the provision of an improved appliance having a seal between the appliance door and the control panel.

Another objective of the present invention is the provision of an appliance control panel having an upstanding surface for sealing with a seal of the appliance door.

Still another objective of the present invention is the provision of a combination tumble and cabinet dryer having doors which sealingly engage with the control panel.

Still another objective of the present invention is the provision of a clothes dryer with a door having a lip to direct condensation away from the control panel.

A further objective of the present invention is the provision of a clothes dryer having a seal and a moisture-directing lip which protect the control panel from exposure to moisture.

These and other objectives will become apparent from the following description of the invention.

SUMMARY OF THE INVENTION

A combination tumble and cabinet clothes dryer includes a housing, with a tumble dryer mounted in the housing, and a cabinet dryer built into the housing. A tumbler door provides access to the tumble dryer, while a pair of French-style cabinet doors provide access to the cabinet dryer. A control panel is mounted on the housing between the tumble dryer and the cabinet dryer to control operation of the dryers. A seal on each of the cabinet doors sealingly engages with an upright surface on the control panel when the cabinet doors are closed to prevent migration of moisture to the control panel. The cabinet doors also include a sloped inner surface with a lip to direct condensation away from the seal.

DETAILED DESCRIPTION OF THE DRAWINGS

Figure 1:
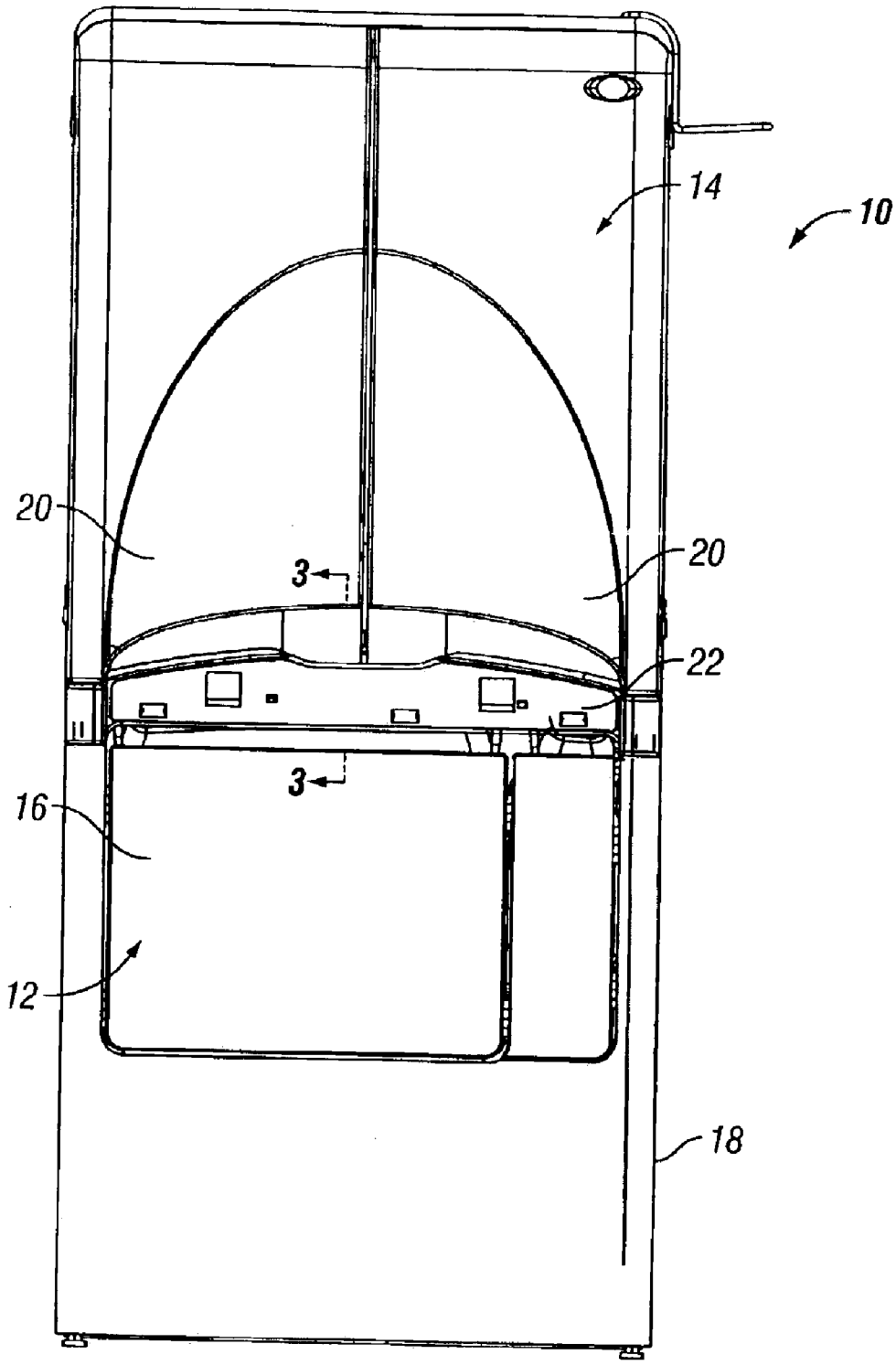
FIG. 1 is a front view of the combination tumble and cabinet dryer of the present invention, with the doors closed.
Figure 2:
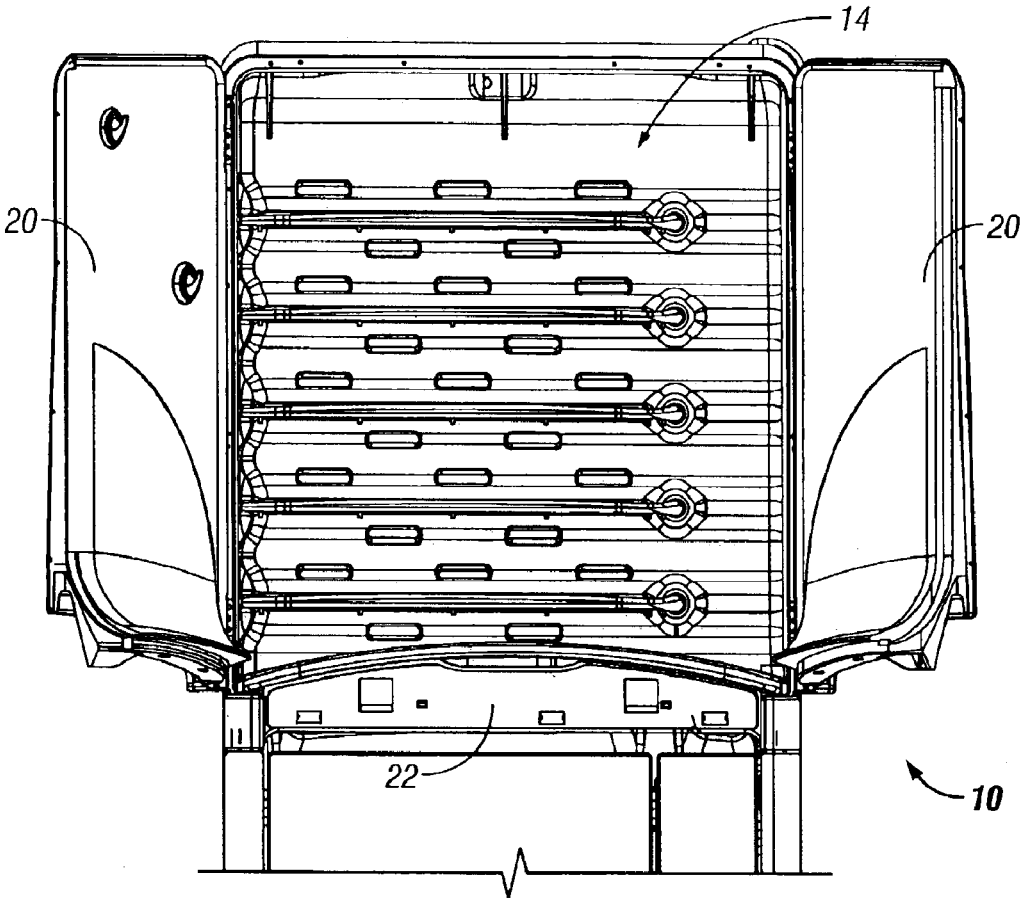
FIG. 2 is an enlarged view showing the doors of the cabinet dryer open.

FIG. 1 shows a combination dryer 10 having a tumble dryer 12 in the lower portion thereof and a cabinet dryer 14 in the upper portion thereof. The general structure of the dryer 10 is described in applicants co-pending application Ser. No. 10/406,814 to Johnson, et al, filed on Apr. 4, 2003 and entitled COMBINATION TUMBLE AND CABINET DRYER. The tumble dryer 12 includes a door 16 pivotally hinged to the housing 18 to provide access to the rotatable drum (not shown) within the tumble dryer 12. A pair of French-style doors 20 are also mounted to the housing 18 to provide access to the interior of the cabinet dryer 14.

A control panel 22 is mounted on the housing 18 between the tumble dryer 12 and the cabinet dryer 14. The control panel 22 controls the operation of both the tumble dryer 12 and the cabinet dryer 14.

Figure 3:
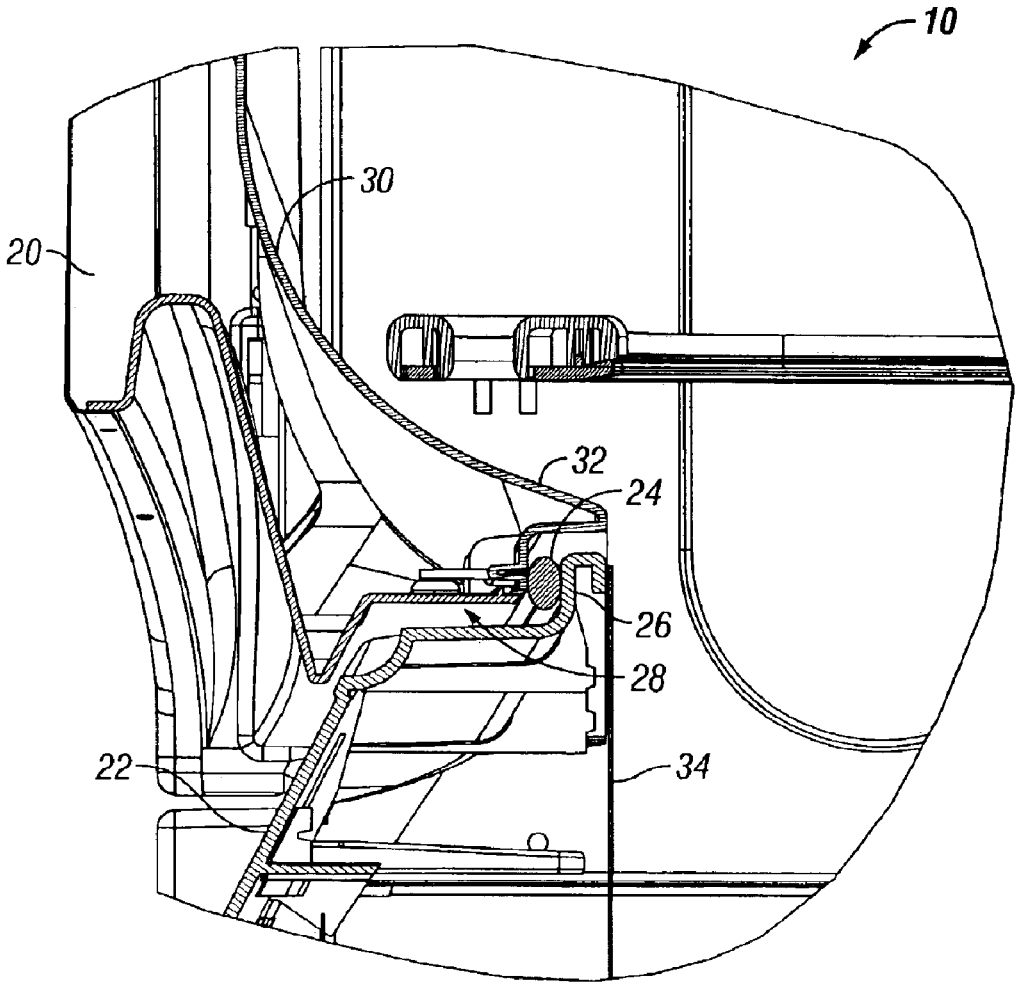
FIG. 3 is an enlarged sectional view taken along lines 3—3 of FIG. 1 and showing the seal and condensation lip of the present invention.

The present invention is directed, in part, towards the seal between the cabinet doors 20 and the control panel 22. More particularly, as seen in FIG. 3, a seal 24 is mounted on the lower edge of the doors 20. While the drawings show the seal 24 to be a bulb-type seal, other types of seals may also be utilized. The control panel 22 includes an upright surface 26 which is adapted to sealingly engage with the seal 24 when the doors 20 are closed. The seal 24, when engaged with the surface 26, prevents moisture from migrating outwardly in the space 28 between the doors 20 and the control panel 22.

The doors 20 include conventional seals extending along opposite sides and at the top of the doors to provide sealing engagement with the housing 18, as is well known in the art. The door 16 of the tumble dryer 12 also includes a conventional seal (not shown).

The inner surface of the doors 20 also include an inwardly sloped lower wall 30 terminating in a lip 32, as best seen in FIG. 3. The sloped wall 30 and lip 32 direct condensation away from the seal 24. Thus, the seal 24 and the lip 32 on the doors 20 function to direct moisture driven from the clothes dried in the cabinet dryer away from the control panel 22.

The control panel 22 has a back panel 34 that also serves as an interior surface of the cabinet dryer 14.

Whereas the invention has been shown and described in connection with the preferred embodiment thereof, it will be understood that any modifications, substitutions, and additions may be made which are within the intended broad scope of the following claims. From the foregoing, it can be seen that the present invention accomplishes at least all of the stated objectives.

What is claimed is:

1. A combination tumble and cabinet clothes dryer, comprising:

a housing;

a tumble dryer mounted in the housing;

a cabinet dryer built into the housing;

a tumbler door for providing access to the tumble dryer;

a cabinet door for providing access to the cabinet dryer;

a control panel on the housing to control the operation of the tumbler and cabinet dryers; and a seal on the cabinet door sealingly engaging the control panel when the cabinet door is closed.

2. The dryer of claim 1 wherein the control panel includes an upright surface to provide sealing engagement with the cabinet door seal.

3. The dryer of claim 1 wherein the seal is a bulb type seal.

4. The dryer of claim 1 wherein the cabinet door includes a pair of French-style door panels.

5. The dryer of claim 1 wherein the cabinet door includes an inner surface with a lip to direct condensation away from the seal.

6. The dryer of claim 5 wherein the lip slopes inwardly to a location beyond the seal.

7. The dryer of claim 1 wherein the control panel includes a back panel to provide an interior surface of the cabinet dryer.

8. A combination tumble and cabinet clothes dryer, comprising:

a housing;

a tumble dryer mounted in the housing;

a cabinet dryer built into the housing;

a tumbler door for providing access to the tumble dryer;

a cabinet door for providing access to the cabinet dryer;

a control panel on the housing to control the operation of the tumbler and cabinet dryers; and the cabinet door having an inner surface with a lip to direct condensation away from the control panel.

9. The dryer of claim 8 further comprising a seal on the cabinet door sealingly engaging the control panel when the cabinet door is closed.

10. The dryer of claim 9 wherein the lip slopes inwardly to a location beyond the seal.

11. The dryer of claim 9 wherein the control panel includes an upright surface to provide sealing engagement with the cabinet door seal.

12. The dryer of claim 9 wherein the seal is a bulb type seal.

13. The dryer of claim 9 wherein the cabinet door includes a pair of French-style door panels.

* * * * *